US007737378B2

(12) United States Patent
Zimmermann

(10) Patent No.: US 7,737,378 B2
(45) Date of Patent: Jun. 15, 2010

(54) SORTING SYSTEM HAVING STORAGE MODULES FOR FLAT MAIL ITEMS WITH LAST-IN/FIRST-OUT OPERATION AND IMPROVED ADDRESS ASSIGNMENT

(75) Inventor: Armin Zimmermann, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 384 days.

(21) Appl. No.: 11/823,723

(22) Filed: Jun. 28, 2007

(65) Prior Publication Data

US 2008/0000814 A1 Jan. 3, 2008

(30) Foreign Application Priority Data

Jun. 28, 2006 (DE) ..... 10 2006 030 096

(51) Int. Cl.
*B07C 5/00* (2006.01)

(52) U.S. Cl. ..... 209/584; 209/900

(58) Field of Classification Search ..... 209/584, 209/900; 271/3.01, 3.03, 3.13; 414/793.1, 414/797.2

See application file for complete search history.

(56) References Cited

U.S. PATENT DOCUMENTS 4,388,994 A * 6/1983 Suda et al. ..... 209/564
4,615,446 A 10/1986 Pavie
4,747,492 A * 5/1988 Saito et al. ..... 209/534
4,778,062 A 10/1988 Pavie et al.
4,883,183 A * 11/1989 Kimura et al. ..... 209/534
5,158,183 A * 10/1992 Beerman et al. ..... 209/546
6,124,561 A * 9/2000 Luckhurst et al. ..... 209/583
7,498,539 B2 * 3/2009 Svyatsky et al. ..... 209/584
2008/0087582 A1 4/2008 Zimmermann

FOREIGN PATENT DOCUMENTS

DE 1 277 606 B1 9/1968

(Continued)

OTHER PUBLICATIONS

Derwent Abstract—DE-10 2004 056 696 A1; Jun. 8, 2006; Siemens AG, D-80333 Muenchen, Germany.

(Continued)

*Primary Examiner*—Patrick Mackey
*Assistant Examiner*—Mark Hageman
(74) *Attorney, Agent, or Firm*—Laurence A. Greenberg; Werner H. Stemer; Ralph E. Locher

(57) ABSTRACT

A sorting system for flat mail items includes a process controller and at least three storage modules connected in a parallel arrangement. Each of the at least three storage modules has a storage area and an infeed function to transfer mail items from a mail item stream into the storage area, and an extraction function to extract mail items from the storage area for generating an improved mail item stream. One of the at least three storage modules is operable in the infeed function, another one of the at least three storage modules operable in the extraction function, and at least one further module of the at least three storage modules is operable in a halt status. Address information is added to the mail items by the process controller for the mail items contained in the storage area of the storage module operated in the halt status.

14 Claims, 3 Drawing Sheets

FOREIGN PATENT DOCUMENTS

| | | | |
|---|---|---|---|
| DE | 1 286 966 | A | 1/1969 |
| DE | 29 45 386 | C2 | 6/1986 |
| DE | 10 2004 056 696 | A1 | 6/2006 |
| EP | 0 552 778 | A2 | 7/1993 |
| EP | 0 429 118 | B1 | 5/1996 |

OTHER PUBLICATIONS

Derwent Abstract—DE-29 45 386 C2; Jun. 19, 1986; Nippon Electric Co. Ltd., Tokyo, Japan.

* cited by examiner

SORTING SYSTEM HAVING STORAGE MODULES FOR FLAT MAIL ITEMS WITH LAST-IN/FIRST-OUT OPERATION AND IMPROVED ADDRESS ASSIGNMENT

BACKGROUND OF THE INVENTION

The present invention relates to a sorting system for flat mail items, said system comprising at least three storage modules connected in a parallel arrangement, wherein each of the at least three storage modules comprises a storage area and an infeed function which transfers mail items from a stream of mail items into the storage area, and an extraction function which extracts mail items from the storage area for the purpose of generating an optimized stream of mail items.

With present-day mail sorting systems, very large quantities of mail items sometimes have to be sorted and distributed in what are referred to as mail centers and/or major post offices. Thus, for example, the average daily volume of mail handled in Germany amounts to approximately 80 million mailings, which are required to reach their addressees already on the very next day or at the latest on the next day but one after posting. Mail items of this kind are generally referred to as "letters". Said mail items are characterized in that their length and width are generally large compared with their height. However, there are sometimes significant differences between the postal administration authorities of the different national states with regard to the definitive dimensions used for assigning mail items to this "letters" group. As well as these size variations it can also easily be seen that the properties of the mail items, even when they are all "letters" may differ considerably from one to another in certain cases.

It is therefore easy to imagine that mail automation processes today have to be operated with a high degree of efficiency and, as a result of cost pressure, also with a comparatively small number of operators. To achieve sufficiently high throughput rates in the sorting machines, the mail items are conveyed through the sorting machine at speeds of up to 4 m/s and in places even more, and are sorted to their destination by means of appropriately switched diverters and a sophisticated, usually multi-stage delivery route sequencing sorting method.

To ensure correct delivery of the mail items it is therefore essential that the address of the mail item can be properly registered once by automated means at least at the beginning of the sorting process. Frequently, however, the address is not machine-readable but must be added by entering the address (or at least the part thereof which is significant for the current sorting process) manually. This fact makes it necessary for the non-machine-readable mail items to be filtered out of the sorting process and buffered while the address is manually assigned. Following manual address assignment, they must then be extracted from the buffer once more and can be fed back into the sorting process.

This buffering is currently achieved by means of what are referred to as storage conveyors on which the incoming individual mail items are transported at a minimum spacing until the time required for interpreting the address and for registering at least certain significant parts of the address has elapsed. Typically, an image which can be read by operators (people) is generated of a non-machine-readable address, the operators then entering the recognized address into the control system, as a result of which the manually entered address is assigned to the mail item and at the next opportunity in the sorting process is printed onto the mail item, usually in the form of a barcode.

A critical factor in dimensioning the length of said storage conveyor is therefore the processing time for recognizing the address and entering and assigning the registered address data to the mail item previously not (correctly) recognized with regard to its address. At the given speeds (as a function of the envisioned throughput) there therefore result storage conveyors which very quickly reach lengths of 50 m or even more. Since the gap displacements between the mail items are approximately proportional to the transport length on the storage conveyor, a corresponding loss in throughput is therefore also associated with a long storage conveyor, because the gap displacements have to be made available in addition to a required minimum gap between two adjacent mail items. Furthermore the storage conveyor itself is attended by a number of disadvantages, because, of course, a correspondingly long storage conveyor also takes up a relatively large amount of space and, of course, also has to be installed, operated and maintained. In order to be able nonetheless to use the generally limited amount of space available in a sorting center as efficiently as possible, the storage conveyor usually runs with a multiple fold, although this also leads to a folding of the mail items and consequently unfortunately also sometimes to considerable damage to the mail items.

As a result of these restrictions the storage conveyor is therefore always set to a certain minimum. This means that the mail items can be evaluated only to a limited depth in terms of information, which on the one hand results in the absence of information depth as regards the address resolution, the completeness of which would, however, be necessary for the delivery route sequencing, leading to additional processing steps. On the other hand this leads to the mail items only being evaluated with a great frequency, which means that the mail items that have not been evaluated have to be processed automatically once again or just have to be processed manually.

SUMMARY OF THE INVENTION

The object underlying the present invention is therefore to train a sorting system to the effect that the mail item buffering function can be performed with an exceptionally low process error rate while at the same time ensuring the correct alignment of the mail items.

This object is achieved according to the invention by a sorting system of the type cited in the introduction, said system comprising at least three storage modules connected in a parallel arrangement, with each of the at least three storage modules comprising a storage area and an infeed function which transfers mail items from a mail item stream into the storage area, and an extraction function which extracts mail items from the storage area for the purpose of generating an optimized mail item stream, wherein at the same time:

a) one of the at least three storage modules can be operated in the infeed function;

b) another of the at least three storage modules can be operated in the extraction function;

c) at least one further module of the at least three storage modules can be operated in a halt status.

In this way it is possible to buffer the mail items while achieving a precise alignment on two edges initially in one of the at least three storage modules and thereby gain the time required for resolving and adding the address information and subsequently again extract the mail items (then correctly aligned and with added address information) from the storage area, while another of the at least three storage modules is then operated in the infeed function and subsequently in the halt status. In this way there is no interruption for the mail item stream, because mail items are also always being extracted again from one of the at least three storage modules. This results in an optimized mail item stream, because the mail items are extracted from the respective storage area correctly spaced and with added address information (either by means of barcode and/or also using IT means) in the process controller. Because in addition each of the storage modules operates either in the infeed function or in the halt status or in the extraction function, optimized boundary conditions can be set for the respective function, thereby considerably reducing the process error rate.

In an expedient embodiment of the present invention it can be provided for each of the at least three storage modules to specify the function sequence: infeed function, halt status and extraction function. In this way one of the storage modules can be filled and another simultaneously emptied, while in the at least one third storage module, which is in the halt status, precisely this idle period (to be understood in the sense that nothing is being buffered therein or extracted therefrom) is used to add address information to the mail items manually or by some other address recognition means. At the same time this process can already also start for the storage module which is currently in the infeed function because with the infeeding of the mail item into the storage area basically the time period for registering and adding the address information starts to run. Thus, the evaluation of the full set of information is made possible on the one hand with the choice of a suitable stacking bed length and on the other hand with the choice of the number of storage modules that are available for this halt status, which in turn creates the possibility of dramatically improving succeeding working processes. In this way, in a further advantageous embodiment of the invention, the sorting system is trained to the effect that at least in the case of the mail items located in the storage area of the storage module operated in the halt status, address information can be added to said mail items.

In a particularly preferred embodiment of the invention, the storage capacity of the storage areas can thus be dimensioned such that a mail item most recently transferred into the storage area of the storage module operated in the infeed function can be stored there for as long as necessary so that address information can be added to said mail item before said storage module is switched to the extraction function.

For particularly good setting of optimized conditions in each case for the infeed function and for the extraction function, each storage module can be embodied in such a way that the infeed function and the extraction function comprise a shared roller belt unit and a feed stop, the infeed function or the extraction function optionally being executable in that in the infeed function the mail items can be guided in the conveying direction of the roller belt unit by the roller belt against the infeed stop and in this way can be transferred into the storage area, and in that in the extraction function the mail item most recently stacked in the conveying direction of the roller belt unit can be extracted from the storage area through an extraction opening. In this way it is nonetheless possible, while largely using common components for the infeed and extraction functions, to functionally separate the infeeding or buffering of mail items into the stack and the extracting of mail items, which in these process stages are usually conveyed for reasons of convenience in a largely vertical orientation, from the stack and so be able to set the most favorable process parameters in each case for each of the two operations. In contrast to the first-in/first-out (FiFo) mode of operation known in the prior art, in this way a last-in/first-out mode of operation can be achieved which during the buffering can concentrate entirely on fulfilling the best possible buffering boundary conditions and during the extraction can concentrate entirely on fulfilling the best possible extraction boundary conditions.

The feed stop, which is particularly important for the buffering and enables the mail items to be centered on two side edges of the mail item for the subsequent extraction, is if anything counterproductive for the extraction function, because when extracted from the storage area the mail items are preferably to be forwarded in the original feed direction. The extraction function is therefore particularly easy to implement in design engineering terms if in order to create the extraction opening the feed stop can be displaced in the stacking direction (direction in which the stack grows in the storage area). The last mail item buffered is therefore then conveyed by the roller belt unit essentially in the orientation of the mail item in the storage area (or at least conveyed still in a vectorial transition which has a noticeable component in the buffering orientation) and can thus, for example, be fed into the running mail item stream.

The bearing pressures on the roller belt unit which are optimized in each case for the infeed function and the extraction function can be realized particularly efficiently if the storage area comprises a separating cutter by means of which, when the infeed function is present, a first pressure can be exerted antiparallel to the stacking direction on at least some of the mail items stored in the storage area and, when the extraction function is present, a second pressure can be exerted antiparallel to the stacking direction on at least some of the mail items stored in the storage area. The stacking direction, in this context, means the direction in which the stack grows when mail items are constantly introduced into the storage area. Said separating cutter can advantageously be driven by means of an underfloor belt or else separately, which in this way is able to generate a constant bearing pressure on the roller belt for each mail item brought to the roller belt unit, independently of the stack size.

In a further advantageous embodiment of the invention it can be provided, for the purpose of achieving particularly suitable bearing pressure conditions on the mail items which are currently being conveyed for buffering or extraction by means of the roller belt unit, to set the first pressure as a function of at least one property of the mail items currently to be buffered and/or the second pressure as a function of at least one property of the most recently buffered mail item. A property of this kind can be for example the thickness and/or the length of a mail item or also the surface texture of a mail item.

Typically, specific limit values for the mail items which can be processed by certain mail sorting machines are specified in agreement with a (mail) customer for said sorting machines. Limit values of this kind are primarily the dimensions of the mail items, i.e. their minimum and maximum width, length and height, and then, secondarily, for example also their weight or their external properties. The roller belt unit which guides the mail items in the infeed function to the feed stop can therefore be dimensioned in an advantageous embodiment of the invention such that a section of a driven roller belt included in the roller belt unit and facing the storage area is shorter than a, by definition, shortest mail item length. In this way the process of buffering can be supported to the extent that the roller belt does not grip the entire mail item and thus does not convey the mail item by means of the drive force transmitted by friction too strongly against the feed stop, as a result of which process errors (bent mail item and blocking of the process) can be avoided even more effectively at this point.

A different initial situation from this can be regarded as given for the extraction of the mail items from the storage area. Once the buffered mail items are very neatly arranged on two edges in the center of the storage area, for optimal further processing (onward conveyance) of the mail items it is desirable to be able to extract the mail items from the storage area in a very defined manner. A previously already cited parameter which supports the extraction operation is the choice of the right contact pressure of the most recently buffered mail item on the roller belt unit. This operation can be particularly advantageously supported if, when the extraction function is present, at least one swivelable supporting roller is provided for supporting the last mail item stored, with the at least one supporting roller being swiveled out when the infeed function is present. Said at least one supporting roller, which is actually required only for the extraction function and is therefore swiveled in for the extraction function, ensures that the entire mail item is positioned essentially parallel to the conveying plane of the roller belt and consequently the drive force of the roller belt can be transferred very homogeneously onto the part of the mail item that is in contact with the roller belt.

In addition to an optimized first pressure, a number of further parameters for the infeed function can be identified which contribute toward the avoidance of process errors. A parameter of this kind can be, for example, the feed direction of the mail items to the roller belt unit. In an advantageous embodiment of the invention the feed direction of the mail items in the mail item stream can therefore be set such that the feed direction runs at an angle to the alignment of the mail items in the storage area. In this way it is possible to support the efforts directed at ensuring that toward the end of this operation the mail item, when being fed into the storage area, is now only in contact with the roller belt in drive terms and so a defined feed to the feed stop can take place.

In a further advantageous embodiment of the invention the roller belt unit can comprise a roller belt driven by means of a servo motor. Thus, a shared roller belt is available both in the infeed function and in the extraction function, which also works out very advantageously in design engineering terms.

As an alternative hereto it could, however, also be provided that the roller belt unit comprises two separately drivable roller belts, with one of the two roller belts being in frictional contact with the mail items to be buffered during the infeed function and the other of the two roller belts being able to brought into frictional contact with the mail items to be extracted from the storage area during the extraction function. In this way, for example, roller belts can be used that are specified for the respective function and have different coefficients of friction. In design engineering terms this solution is a little more complicated, however, because a mechanism must be present which brings the two different belts into frictional engagement with the mail items in accordance with the selected function. Conceivable in this case is for example a swivel device which swivels one of the roller belts into a frictional contact position, while at the same time the other roller belt is swiveled out of the frictional contact position (and vice versa). A further alternative can also be an eccentric shaft which lifts one roller belt into the frictional contact position and at the same time lowers the other roller belt (and vice versa).

It is furthermore particularly advantageous if each of the aforementioned roller belts can be driven by means of a servo motor which drives the roller belt with a predefinable profile. In this way it is possible for example to drive the mail item more slowly at the end of the infeed movement and thereby bring it gently to the infeed stop. With very short mail items provision can even be made for the temporary stopping of the mail item before it reaches the infeed stop. The stopping point can be defined for example as a location at which the trailing edge of the comparatively short mail item (and hence also the leading edge which is important for correct positioning) is still sufficiently far away from the infeed stop so that when the roller belt is driven once again the mail item can then be driven at the speed desired for the next mail items before the slowing down is provided to ensure the gentle final approach to the feed stop.

In order to largely decouple the frictional contact of the mail items with all the herein above-described components for conveying the mail items from the gravitational force of the mail items it is provided in an advantageous development of the invention to orientate the mail items essentially vertically and/or align them lying on their long edge.

Further advantageous embodiments of the invention may be derived from the remaining dependent claims.

BRIEF DESCRIPTION OF THE SEVERAL VIEWS OF THE DRAWINGS

Exemplary embodiments of the invention are explained in more detail below with reference to a drawing, in which.

DETAILED DESCRIPTION OF THE INVENTION

Figure 1:
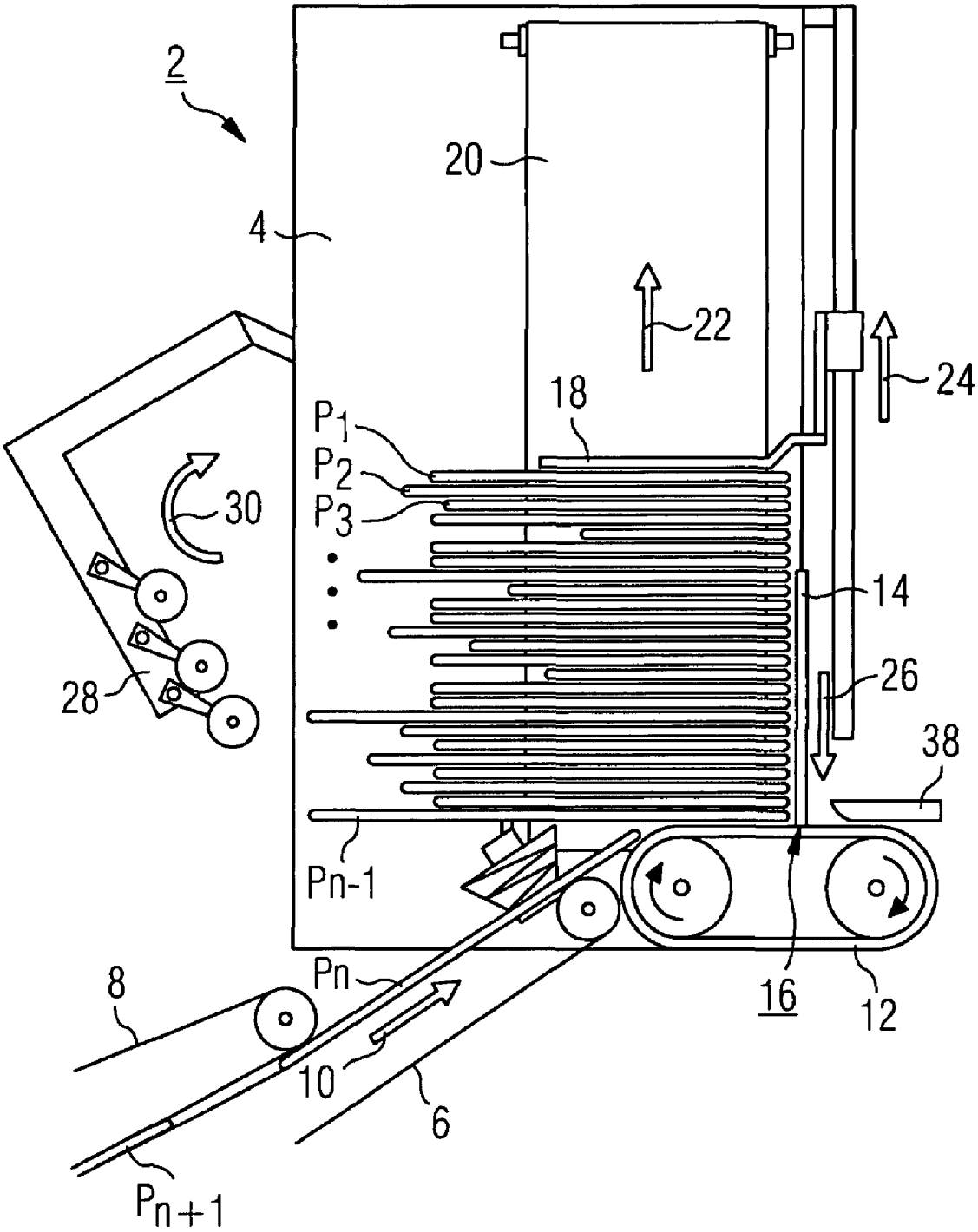
FIG. 1 shows in a schematic representation a plan view of a storage module in the infeed function.
Figure 2:
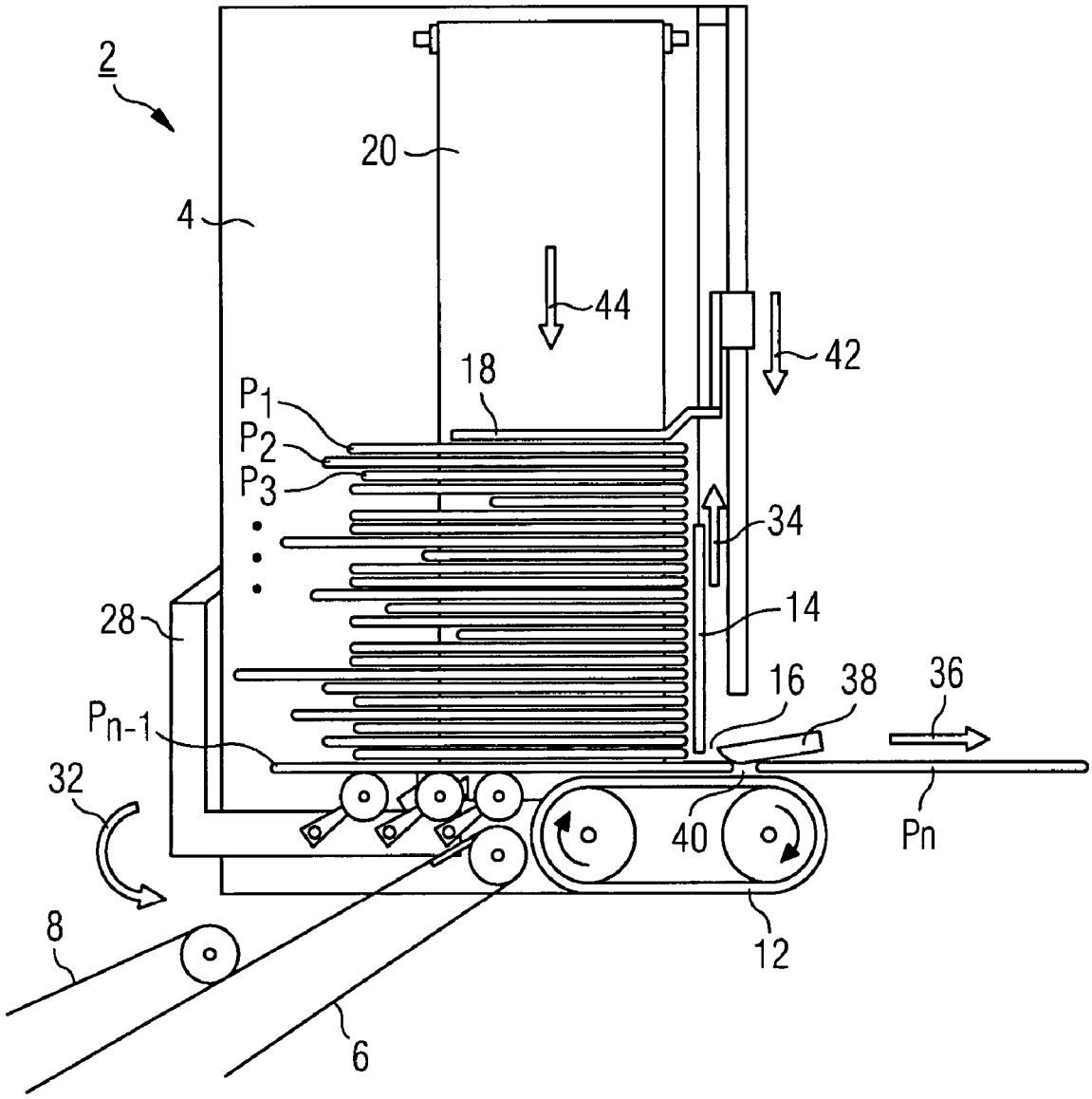
FIG. 2 shows in a schematic representation a plan view of the storage module according to FIG. 1 in the extraction function.
Figure 3:
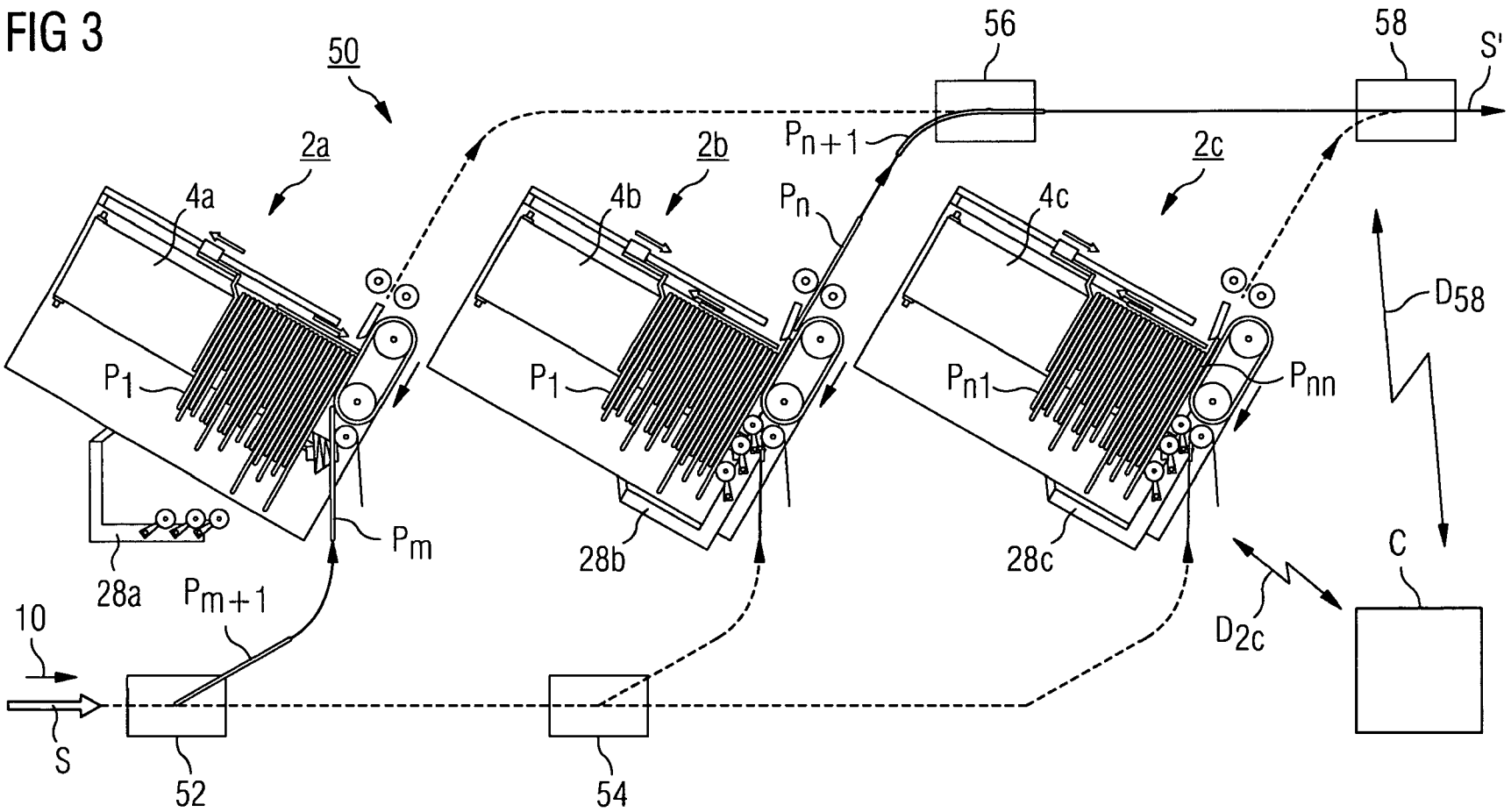
FIG. 3 shows in a schematic representation a sorting system comprising three storage modules according to FIGS. 1 and 2.

Initially it should be noted that the plan views shown in FIGS. 1 to 3 illustrate the essentially vertical orientation of the mail items. In FIGS. 1 to 3 the plan views therefore all show only the top edge of the mail items.

FIG. 1 shows in a schematic diagram a view from above onto an inventive storage module 2 which, in the representation shown, is operating in the infeed function. The storage module 2 comprises a storage area 4 in which mail items $P_1$, $P_2$, $P_3$, . . . , $P_{n-1}$ are currently buffered. In the representation shown, the mail item $P_n$ will be the next mail item transferred into the storage area 4. Said mail item $P_n$ is in the present example being fed between two feed belts 6, 8 to the storage module 2 in the direction of an arrow 10—hereinafter called the conveying direction 10—and then taken over by a roller belt 12 of the storage module 2. The roller belt 12 is in this case driven under control and conveys the mail items $P_1$, $P_2$, $P_3$, . . . , $P_{n-1}$ to a feed stop 14, as a result of which the mail items $P_1$, $P_2$, $P_3$, . . . , $P_{n-1}$ are then situated in a precisely defined position in the storage area 4 relative to their leading and bottom edge. In the position shown in FIG. 1 the feed stop 14 also blocks an extraction opening 16 which will be dealt with in more detail in the description relating to FIG. 2. An arrow 26 is therefore intended to indicate that in the top view shown (looking downwards) the feed stop 14 is guided as far as immediately in front of the roller belt 12.

For the precise positioning of the mail items $P_1$, $P_2$, $P_3$, . . . , $P_{n-1}$ in the storage area 4 it is therefore essential that the mail items $P_1$, $P_2$, $P_3$, . . . , $P_{n-1}$ are brought into contact with the roller belt 12 with a certain feed pressure. It is easy to see that, due to too low a feed pressure, only a delayed conveying of the mail item currently to be buffered, in this case mail item $P_n$, and an undesirable overlapping with an already following mail item $P_{n+1}$ could occur. This can result in the mail item $P_n$ no longer being guided quite correctly as far as the feed stop 14. On the other hand, too high a feed pressure with only a small number of inflexible mail items can lead to the mail item being bent or folded over in an undesirable manner ahead of the feed stop 14 with the consequence that the bent/folded mail item would have to be smoothed out again by hand. Given the prevailing conveying speeds of several meters per second for the mail items (outside of the storage area 4 it is easy to comprehend that each process disruption usually affects not just one mail item, but generally always a whole series of mail items within a conveying path).

For the purpose of setting a feed pressure optimized in this regard, a separating cutter 18 and an underfloor belt 20 are provided which can be very finely regulated in the infeed function of the storage module 2 and are movable in the stacking direction according to arrows 22, 24. By means of the separating cutter 18 a first pressure is thus generated antiparallel to the stacking direction in order to set the desired feed pressure on the roller belt 12 for conveying the mail items to be buffered in each case.

The storage module 2 also has a supporting roller arrangement 28 which, in the infeed function shown in FIG. 1, is swiveled into an inactive state. An arrow 30 is intended here to illustrate the swiveling direction of the supporting roller arrangement 28 by way of example.

FIG. 2 now shows a schematic view from above onto the storage module 2 which in this case is being operated in the extraction function. In contrast to the infeed function, a number of components of the storage module are now in a different position. The supporting roller arrangement 28 is now located in the swiveled-in active state, which is also intended to be indicated by an arrow 32 with regard to the swiveling direction. In this case the supporting roller arrangement 28 ensures that first and foremost the next mail item to be extracted, in this case the mail item $P_{n-1}$ is aligned in a plane which essentially corresponds to the conveying plane spanned by the roller belt 12 and in the local area of the storage module 2 also essentially corresponds to the further conveying orientation. In this way the mail item to be extracted rests flat against the roller belt 12 and can thus be extracted in a defined manner.

So that it is made possible to extract the buffered mail items in the first place, the feed stop 14 is moved away upward in the extraction function in the schematic representation according to arrow 34 and thus exposes the extraction opening 16. The snapshot shown in FIG. 2 shows the mail item $P_n$ which is already fully extracted and is being conveyed onward in the direction of an arrow 36, and the mail item $P_{n-1}$ whose leading edge 40 is currently emerging through the extraction opening 16 and is held in contact with the roller belt 12 by a deflector 38. In this arrangement the deflector 38 supports the avoidance of double extractions, since its coefficient of friction is fine-tuned to the frictional torque acting on the roller belt and in the event of a double extraction holds back the mail item that is not in direct contact with the roller belt. In order that the item $P_n$ could be conveyed with a very precisely defined orientation of its leading edge and the mail item $P_{n-1}$ is currently being conveyed in this way, an optimized extraction pressure of the mail item onto the roller belt 12 is now set here. For this purpose a second pressure is built up by means of the separating cutter 18 antiparallel to the stacking direction (cf. arrow 42). The setting of the right extraction pressure is also significant during the extraction function in order to avoid process errors, because too low an extraction pressure can lead for example to an undesirable slipping of the roller belt 12 and consequently to an imprecise conveying of the mail item that is currently to be extracted. On the other hand, too high an extraction pressure can lead to a multiple extraction or even to a jamming of the lower mail items illustrated in the drawing.

In order to be able to guarantee the largely vertical orientation of the mail items contained in the storage area 4 also during the continuing extraction of mail items, the underfloor belt 20 is also driven in the direction of an arrow 44 and thus, in interaction with the pretensioned separating cutter 18, displaces the mail items stored in the storage area 4.

FIG. 3 now shows the exemplary arrangement of three storage modules 2*a*, 2*b*, 2*c* in an inventive sorting system 50 (the use of reference numerals from FIGS. 1 and 2 has therein been restricted to the necessary). The three storage modules 2*a*, 2*b*, 2*c*, which are identical in design to the storage module 2, are connected in a parallel arrangement, wherein in the present scenario the storage module 2*a* operates in the infeed function, the storage module 2*b* operates in the extraction function and the storage module 2*c* operates in the halt status. This assignment of the function is very clearly recognizable for example by the position of the supporting roller arrangements 28*a*, 28*b*, 28*c*. For the infeed function the supporting roller arrangement 28*a* is in the swiveled-out passive state, and for the extraction function the supporting roller arrangement 28*b* is in the swiveled-in active state. The supporting roller arrangement 28*c* has already been switched into the swiveled-in active state because the storage module 2*c* currently in the halt status will subsequently be switched over to the extraction function.

Corresponding to this function assignment, a first diverter device 52 which is connected upstream of the storage modules 2*a*, 2*b*, 2*c* in feed direction 10 (direction of a mail item stream S) is set such that the mail items supplied in the mail item stream S are fed to the storage module 2*a* which feeds the mail items $P_1$ to $P_{m+k}$ identified by an index m (where k is a natural number greater than 1) into the storage area 4*a* by means of its infeed function. A second diverter device 54 which switches the mail item stream S to the storage module 2*b* is currently not involved in the conveying process. However, since the storage module 2*b* is currently being operated in the extraction function, said storage module 2*b* will be operated in the infeed function following the next switching operation (function rotation). A third diverter device 56 is therefore currently active, because the mail items extracted from the storage module 2*b* via said diverter device 56 represent the optimized mail item stream S'. In this case, in the representation shown, the mail items $P_1$ to $P_{n-1}$ have already been extracted from the storage module 2*b* operated in the extraction function and in the process formed into the optimized mail item stream S'. In the representation shown, the mail items $P_{n+1}$ and $P_n$ have already been extracted from the storage area 4*b* and are located in the third diverter device 56 or on the conveying path to the third diverter device 56. Accordingly, a fourth diverter device 58 is currently inactive, because the storage module 2*c* is in the halt status. To illustrate the current conveying paths of the mail items during infeeding into the storage area 4*a* and during extraction from the storage area 4*b*, said conveying paths are represented by solid lines. All the remaining conveying paths currently not being passed through by mail items are shown as dashed lines.

An address recognition and assigning method runs in the background for the mail items $P_{n1}$ to $P_{nn}$ which are buffered in the storage module 2*c* which is in the halt status. Methods of said kind are basically known and are therefore relevant to the system according to the present invention only in so far as the time period which is required for the address recognition and assignment is an important control variable for the running process and of course also for the preceding dimensioning of the sorting system 50. In addition to the storage bed length of the storage areas 4*a* to 4*c*, the number of storage modules 2*a* to 2*c* is, of course, also an important variable for dimensioning the residence time of the mail items in the buffered state. What is significant about the present sorting system 50 above all in this case is its operational state, wherein one storage module is always in the infeed function and one storage module is always in the extraction function between two switching operations of the diverter devices 52 to 58. An arbitrary (expedient) number of further storage modules can be in the halt status with the address recognition and assignment running in the background, with the result that after the emptying of the storage module currently in the extraction function a switching operation can be carried out with the corresponding function rotation. In this case the function rotation specifically comprises the following changes:

a) the storage module currently operated in the infeed switches to the halt status;

b) one of the storage modules currently operated in the halt status switches to the extraction function; and c) the storage module currently operated in the extraction function switches to the infeed function.

The storage modules 2*a*, 2*b* 2*c*, the first to fourth diverter devices 52 to 58 and the aforementioned switching operations are all controlled by means of a control unit C which in the present scenario communicates bidirectionally with these components predominantly wirelessly, which is intended to be symbolized by data arrows $D_{58}$ (data from and to the fourth diverter device 58) and $D_{2c}$ (data from and to the storage module 2*b*) as representative of all the components to be controlled. The applied control algorithms can, of course, be of a manifold nature and are usually derived on the basis of empirically acquired measurement data. A simple control rule can for example provide that the four diverter devices 52 to 58 and the function type of the three storage modules 2*a*, 2*b*, 2*c* are switched over when the storage area of the storage module operated in the infeed function (in this case storage module 2*a*) has reached a predefined fill level. However, further control parameters can also be the mail item inflow, the optimized mail item outflow, the storage capacity of the storage modules, their current fill level and the status of the address assignment. These parameters can also be combined in an expedient way with one another as input variables for the controlling function.

I claim:

1. A sorting system for flat mail items, comprising:

a process controller; and at least three storage modules connected in a parallel arrangement, wherein each of the at least three storage modules comprises a storage area and an infeed function configured to transfer mail items from a mail item stream into the storage area, and an extraction function configured to extract mail items from the storage area for generating an improved mail item stream, wherein said process controller is adapted to control the at least three storage modules such that one of the at least three storage modules operates in the infeed function another one of the at least three storage modules simultaneously operates in the extraction function, and at least one further module of the at least three storage modules operates in a halt status, wherein said process controller includes means for adding address information to the mail items for at least the mail items contained in the storage area of the storage module operated in the halt status, and wherein each the at least three storage modules can buffer a plurality of mail items and can provide a last-in/first-out operation during an extraction of the buffered mail items.

2. The sorting system of claim 1, wherein a storage capacity of the storage areas of the at least three storage modules is dimensioned such that a mail item most recently transferred into the storage area of the storage module operated in the infeed function is storeable there for as long as necessary so that address information is addable to said mail item by said process controller before said storage module is switched to the extraction function by said process controller.

3. The sorting system of claim 1, wherein said process controller is adapted to provide a function sequence of infeed function, halt status and extraction function for each of the at least three storage modules.

4. The sorting system of claim 1, wherein each of the at least three storage modules includes a shared roller belt unit and a feed stop, wherein said shared roller belt unit and said feed stop are arranged such that in the infeed function the mail items are guided in the conveying direction of the roller belt unit by the roller belt unit against the feed stop and in this way are transferable into the storage area, and that in the extraction function a most recently stacked mail item in the conveying direction of the roller belt unit is extracted from the storage area through an extraction opening of the storage module.

5. The sorting system of claim 4, wherein the feed stop is displaceable in the stacking direction in order to create the extraction opening.

6. The sorting system of claim 4, wherein each of the at least three storage modules includes a separating cutter by means of which, when the infeed function is present, a first pressure is exerted antiparallel to the stacking direction on at least some of the mail items stored in the storage area and, when the extraction function is present, a second pressure is exerted antiparallel to the stacking direction on at least some of the mail items stored in the storage area.

7. The sorting system of claim 6, wherein the separating cutter is configured to be driven by means of an underfloor belt of the storage module.

8. The sorting system of claim 6, wherein each of the at least three storage modules is adapted to set the first pressure as a function of at least one property of the mail items currently to be buffered, and to set the second pressure as a function of at least one property of the most recently buffered mail item.

9. The sorting system of claim 4, wherein a section of the roller unit facing the storage area of the storage modules is shorter than a, by definition, shortest mail item length.

10. The sorting system of claim 4, wherein the storage module includes at least one swivelable supporting roller adapted to support the most recently buffered mail item when the extraction function is present, and wherein the at least one swivelable supporting roller is further adapted to swivel out when the infeed function is present.

11. The sorting system of claim 4, wherein a feed direction of the mail items in the mail item stream runs at an angle to the alignment of the mail items in the storage area.

12. The sorting system of claim 4, wherein the storage area of the storage modules includes an underfloor belt which is movable in the stacking direction of the mail items or antiparallel to the stacking direction of the mail items.

13. A sorting system for flat mail items, comprising:

a process controller; and at least three storage modules connected in a parallel arrangement, wherein each of the at least three storage modules comprises a storage area and an infeed function configured to transfer mail items from a mail item stream into the storage area, and an extraction function configured to extract mail items from the storage area for generating an improved mail item stream, wherein said process controller is adapted to control the at least three storage modules such that one of the at least three storage modules operates in the infeed function, another one of the at least three storage modules simultaneously operates in the extraction function, and at least one further module of the at least three storage modules operates in a halt status, wherein said process controller comprises means for adding address information to the mail items for at least the mail items contained in the storage area of the storage module operated in the halt status, wherein said process controller is further adapted to provide a function rotation wherein the storage module currently operated in the infeed function is switched to the halt status, one of the storage modules currently operated in the halt status is switched to the extraction function, and the storage module currently operated in the extraction function is switched to the halt status, wherein each of the at least three storage modules can buffer a plurality of mail items, and wherein said process controller is adapted to switch over a function type of the storage modules when the storage area of the storage module operated in the infeed function has reached a predefined level.

14. The sorting system of claim 13, wherein the at least three storage modules are adapted to provide a last-in/first-out operation during extraction of the buffered mail items.

* * * * *